US010317831B2

(12) United States Patent
Onodera

(10) Patent No.: US 10,317,831 B2
(45) Date of Patent: Jun. 11, 2019

(54) IMAGE FORMING SYSTEM, IMAGE FORMING METHOD, IMAGING FORMING APPARATUS, JOB MANAGEMENT METHOD, AND COMPUTER-READABLE NON-TRANSITORY RECORDING MEDIUM STRONG JOB MANAGEMENT PROGRAM

(71) Applicant: Konica Minolta, Inc., Chiyoda-ku Tokyo (JP)

(72) Inventor: Masahiro Onodera, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/915,627

(22) Filed: Mar. 8, 2018

(65) Prior Publication Data

US 2018/0259890 A1 Sep. 13, 2018

(30) Foreign Application Priority Data

Mar. 13, 2017 (JP) ..... 2017-047082

(51) Int. Cl.
*G03G 15/20* (2006.01)
*G03G 15/00* (2006.01)

(52) U.S. Cl.
CPC ..... *G03G 15/50* (2013.01); *G03G 15/2064* (2013.01); *G03G 15/6591* (2013.01); *G03G 15/6594* (2013.01); *G03G 2215/00021* (2013.01); *G03G 2215/00126* (2013.01); *G03G 2215/00523* (2013.01); *G03G 2215/00738* (2013.01)

(58) Field of Classification Search
CPC ..... G03G 15/5075; G03G 15/2064; G03G 15/50; G03G 15/6591; G03G 15/6594; G03G 2215/00126; G03G 2215/00523
See application file for complete search history.

(56) References Cited

U.S. PATENT DOCUMENTS 8,494,392 B2 * 7/2013 Kasahara ..... G03G 15/238 347/262
8,755,709 B2 * 6/2014 Nose ..... G03G 15/231 399/82

(Continued)

FOREIGN PATENT DOCUMENTS

JP 2010152129 A 7/2010

*Primary Examiner* — Francis C Gray
(74) *Attorney, Agent, or Firm* — Cantor Colburn LLP

(57) ABSTRACT

An image forming system includes first and second image forming apparatuses including respective image forming sections and fixing sections. When the system forms an image on a sheet using the first image forming section, then forms an image on the sheet using the second image forming apparatus, and forms an image on a same side of a sheet which has a nonuniform sheet thickness and first and second regions respectively having small and large sheet thicknesses, the image in the first region is formed and fixed using the first image forming apparatus and the image in the second region is formed and fixed using the second image forming apparatus, and the respective fixing sections of the first and the second image forming apparatuses pass the nonuniform sheet while applying a second load lower than a first load applied to a sheet having a uniform sheet thickness.

15 Claims, 10 Drawing Sheets

(56) References Cited

U.S. PATENT DOCUMENTS

| | | | | |
|---|---|---|---|---|
| 8,965,234 | B2 * | 2/2015 | Ikuta | G03G 15/0189 358/1.18 |
| 2006/0039728 | A1 * | 2/2006 | deJong | G03G 15/238 399/381 |
| 2006/0233569 | A1 * | 10/2006 | Furst | G03G 15/234 399/162 |
| 2010/0296829 | A1 * | 11/2010 | Young | G03G 21/14 399/76 |
| 2011/0076045 | A1 * | 3/2011 | Sobue | G03G 15/5062 399/81 |
| 2012/0120420 | A1 * | 5/2012 | Miyazaki | H04N 1/6033 358/1.9 |
| 2013/0011171 | A1 * | 1/2013 | Tamura | G03G 15/2021 399/321 |
| 2017/0357470 | A1 * | 12/2017 | Kouguchi | G03G 15/5087 |
| 2018/0077314 | A1 * | 3/2018 | Nishi | H04N 1/32545 |
| 2018/0210383 | A1 * | 7/2018 | Furukawa | G03G 15/231 |

* cited by examiner

IMAGE FORMING SYSTEM, IMAGE FORMING METHOD, IMAGING FORMING APPARATUS, JOB MANAGEMENT METHOD, AND COMPUTER-READABLE NON-TRANSITORY RECORDING MEDIUM STRONG JOB MANAGEMENT PROGRAM

CROSS REFERENCE TO RELATED APPLICATIONS

The present invention claims priority under 35 U.S.C. § 119 to Japanese Patent Application No. 2017-47082, filed on Mar. 13, 2017, which is incorporated herein by reference in its entirety.

BACKGROUND

1. Technological Field

The present invention relates to an image forming system, an image forming method, an image forming apparatus, a job management method, and a computer-readable non-transitory recording medium storing a job management program.

2. Description of the Related Art

An image forming apparatus (printer, copying machine, facsimile, or the like) using electrophotographic technology performs a fixing process of passing (heating under pressure) toner images transferred onto a sheet by an image forming section through a fixing nip of a fixing section and discharges the sheet subjected to the fixing process out of the apparatus.

Recently, there has been a demand to print an image on a partially thickened sheet such as a chip-embedded sheet using an image forming apparatus such as described above. Compared to a sheet of uniform thickness, the chip-embedded sheet has a very large difference (height difference) between thick part and thin part. Consequently, in printing toner images on a sheet such as a chip-embedded sheet, there is a problem in that if a fixing process is performed using normal fixing pressure (fixing load), durability of fixing members, such as rollers, forming a fixing nip is decreased.

A technique for dealing with problems peculiar to image formation on such a special sheet has not yet been proposed. For example, Japanese Patent Application Laid-Open No. 2010-152129 (hereinafter referred to as PTL 1) discloses a technique for changing a gloss level of an image formed on the same side of a same recording sheet as follows: images are formed by dividing the gloss level into plural sublevels according to desired units of gloss level change and the number of fixing processes is controlled to vary among the formed images. However, the technique described in PTL 1 assumes the use of a normal sheet uniform in sheet thickness, and cannot solve the above-mentioned problem in that the durability of fixing members is decreased when printing an image on a partially thickened sheet such as a chip-embedded sheet.

In printing on recording material such as chip-embedded sheet, as a means of ensuring the durability of fixing members, it is conceivable to reduce the pressure (fixing load) of the fixing nip against the recording material during the fixing process. On the other hand, when the fixing load is reduced, there is a problem in that although in a thickened region in which the IC chip is placed, fixability is ensured by nip surface pressure increased during passage of a sheet, in a thin region in which no IC chip is placed, fixability cannot be ensured because of low nip surface pressure.

SUMMARY

An object of the present invention is to provide an image forming system, an image forming method, an image forming apparatus, a job management method, and a computer-readable non-transitory recording medium storing a job management program, where when forming an image on a partially thickened sheet nonuniform in sheet thickness, the image forming system, image forming method, image forming apparatus, job management method, and job management program can ensure good fixability and ensure durability of members forming a fixing nip.

To achieve at least one of the aforementioned objects, according to an aspect of the present invention, an image forming system reflecting one aspect of the present invention comprises a first image forming apparatus and a second image forming apparatus, the first and the second image forming apparatuses including respective image formers and fixers, where the image forming system forms an image on a sheet using the first image former, and then forms an image on the sheet using the second image forming apparatus, wherein, in a case where an image is formed on a sheet which is nonuniform in sheet thickness and which includes a first region having a small sheet thickness and a second region having a large sheet thickness, the image in the first region is formed and fixed using the first image forming apparatus and the image in the second region is formed and fixed using the second image forming apparatus, and the respective fixers of the first and the second image forming apparatuses pass the sheet which is nonuniform in sheet thickness, while applying a second load as a fixing load, lower than a first load applied to a sheet which is uniform in sheet thickness.

To achieve at least one of the aforementioned objects, according to an aspect of the present invention, an image forming method reflecting another aspect of the present invention is a method for forming, using an image forming apparatus including an image former and a fixer, an image on a sheet which is nonuniform in sheet thickness and which includes a first region having a small sheet thickness and a second region having a large sheet thickness, the image forming method comprising forming and fixing an image in the first region in a first printing process and forming and fixing an image in the second region in a second printing process, wherein in the first and the second printing processes, the fixer passes the sheet which is nonuniform in sheet thickness, while applying a second load as a fixing load, lower than a first load applied to a sheet which is uniform in sheet thickness.

To achieve at least one of the aforementioned objects, according to an aspect of the present invention, an image forming apparatus reflecting another aspect of the present invention comprises:

an image former that forms a toner image on a sheet;

a fixer that fixes the toner image on the sheet; and a hardware processor that controls, in a case where the image is formed on a sheet which is nonuniform in sheet thickness and which has a first region having a small sheet thickness and a second region having a large sheet thickness, the image former and the fixer such that a toner image in the first region is formed and fixed in a first printing process and an image in the second region is formed and fixed in a second printing process, wherein the hardware processor controls the fixer so as to pass the sheet which is nonuniform in sheet thickness and to apply at the same time a second load as a fixing load in the first and the second printing processes, lower than a first load applied to a sheet which is uniform in sheet thickness.

To achieve at least one of the aforementioned objects, according to an aspect of the present invention, a job management method reflecting another aspect of the invention is a method for assigning a print job to printing apparatuses each being configured to form an image on a sheet and registered on a network, each of the printing apparatuses being either a tandem machine including first and second image forming apparatuses including respective image formers and fixers, or a single-machine including an image former and a fixer, wherein, when a print job of forming an image on a sheet which is nonuniform in sheet thickness and which has a first region having a small sheet thickness and a second region having a large sheet thickness is received, at least one of the printing apparatuses that executes the print job is specified by taking operating statuses of the registered printing apparatuses into consideration, and the specified printing apparatus is instructed to:

form and fix an image in the first region in a first printing process and form and fix an image in the second region in a second printing process; and apply a second load as a fixing load in the first and the second printing processes, lower than a first load applied to a sheet which is uniform in sheet thickness.

To achieve at least one of the aforementioned objects, according to an aspect of the present invention, a computer-readable non-transitory recording medium reflecting another aspect of the present invention is a medium storing a job management program executed by a server that assigns a print job to printing apparatuses each being configured to form an image on a sheet and registered on a network, each of the printing apparatuses being either a tandem machine including first and second image forming apparatuses including respective image formers and fixers, or a single-machine including an image former and a fixer, wherein the job management program causes the server to carry out a procedure comprising:

specifying at least one of the printing apparatuses that executes the print job, by taking operating status of the registered printing apparatuses into consideration, upon receiving a print job of forming an image on a same side of a sheet which is nonuniform in sheet thickness and which has a first region having a small sheet thickness and a second region having a large sheet thickness; and instructing the specified printing apparatus to form and fix an image in the first region in a first image formation process and form and fix an image in the second region in a second image formation process and apply a second load in the first and the second printing processes, lower than a first load applied to a sheet which is uniform in sheet thickness.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described with reference to the drawings. However, the scope of the invention is not limited to the disclosed embodiments.

Embodiment 1

Figure 1:
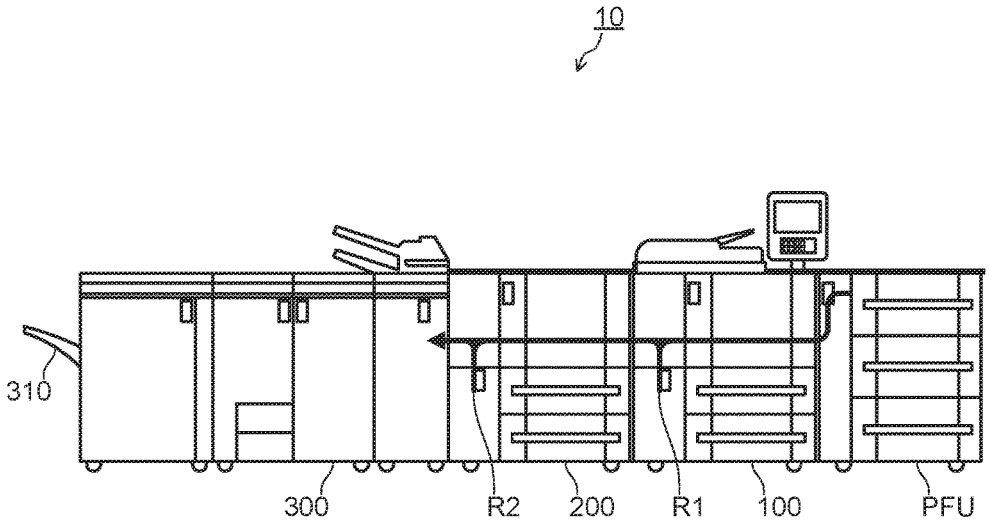
FIG. 1 shows an overall configuration of an image forming system according to Embodiment 1.

FIG. 1 shows an overall configuration of image forming system 10 according to Embodiment 1. Image forming system 10 is made up of sheet feed unit PFU, first image forming apparatus 100, second image forming apparatus 200, post-processing apparatus 300, and the like, which are connected in sequence. First image forming apparatus 100 includes reversal mechanism R1 while second image forming apparatus 200 includes reversal mechanism R2. Post-processing apparatus 300 includes sheet output tray 310. The arrow in FIG. 1 indicates a sheet conveyance path. A system made up of two or more image forming apparatuses connected in series, such as image forming system 10 shown in FIG. 1, is generally called a series-tandem image forming system.

First, a case in which images are printed on a sheet uniform in sheet thickness (hereinafter also referred to as a normal sheet) will be described. In the case of simplex printing on a normal sheet, image forming system 10 feeds a sheet from sheet feed unit PFU, does simplex printing using first image forming apparatus 100 and merely conveys the sheet on second image forming apparatus 200. Alternatively, image forming system 10 feeds a sheet from sheet feed unit PFU, merely conveys a sheet on first image forming apparatus 100 without printing, and does simplex printing using second image forming apparatus 200. Now, a flow of printing will be described in detail using the former case as a representative case. First, image forming system 10 feeds a sheet from sheet feed unit PFU and prints on a front side of the sheet using first image forming apparatus 100. Subsequently, image forming system 10 conveys the sheet to second image forming apparatus 200. Then, image forming system 10 passes the simplex-printed sheet through second image forming apparatus 200. When post-processing is needed, image forming system 10 makes post-processing apparatus 300 apply post-processing such as multi-folding, saddle stitching, or side stitching or processing such as reversal to the simplex-printed sheet. Finally, image forming system 10 ejects the simplex-printed sheet onto sheet output tray 310.

When doing duplex printing on a normal sheet, the image forming system 10 feeds a sheet from sheet feed unit PFU and prints on a front side (upper side) of the sheet using first image forming apparatus 100. Subsequently, image forming system 10 conveys the sheet to second image forming apparatus 200. Then, image forming system 10 prints on a back side (lower side) of the sheet using second image forming apparatus 200. After printing on the back side of the sheet, image forming system 10 makes reversing mechanism R2 reverse the sheet and conveys the reversed sheet to post-processing apparatus 300. When post-processing is needed, image forming system 10 makes post-processing apparatus 300 apply post-processing such as multi-folding, saddle stitching, or side stitching to the sheet. Finally, image forming system 10 ejects the duplex-printed or post-processed sheet onto sheet output tray 310.

Also, image forming system 10 according to the present embodiment is designed to be able to print on a partially thickened chip-embedded sheet, and details of such a printing process will be described later. Hereinafter the term "sheet" when used without any modification can mean both a normal sheet and a chip-embedded sheet.

Figure 2:
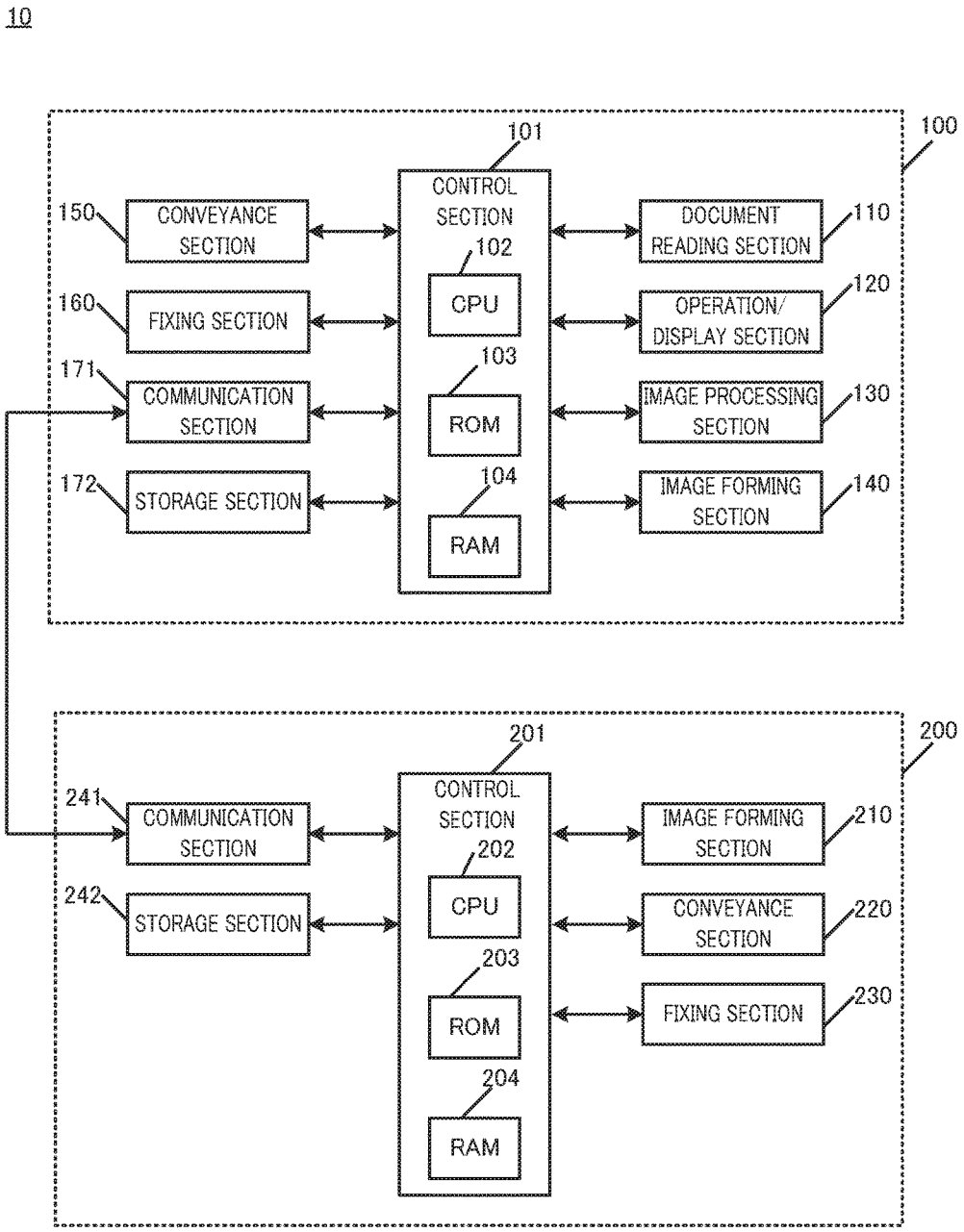
FIG. 2 is a functional block diagram of the image forming system of FIG. 1.

Next, a functional configuration of image forming system 10 will be described. As shown in FIG. 2, image forming system 10 is an MFP (Multi Function Peripheral) that includes first image forming apparatus 100 and second image forming apparatus 200. Note that in FIG. 2, illustration of sheet feed unit PFU and post-processing apparatus 300 is omitted.

First image forming apparatus 100 includes control section 101, document reading section 110, operation/display section 120, image processing section 130, image forming section 140, conveyance section 150, fixing section 160 (first fixing section), communication section 171, and storage section 172.

Control section 101 includes CPU (Central Processing Unit) 102, ROM (Read Only Memory) 103, RAM (Random Access Memory) 104, and the like. CPU 102 reads a program corresponding to processing details out of ROM 103, loads the program into RAM 104, and controls various blocks of first image forming apparatus 100 in collaboration with the loaded program. This is done by referring to various data stored in storage section 172. Storage section 172 is made up, for example, of a non-volatile semiconductor memory (so-called flash memory) or a hard disk drive.

Control section 101 exchanges various data, via communication section 171, with an external apparatus (e.g., a personal computer) connected to a communication network such as a LAN (Local Area Network) or WAN (Wide Area Network). Control section 101 receives, for example, image data transmitted from the external apparatus, and causes an image to be formed on a sheet based on the image data (input image data). Communication section 171 is made up, for example, of a communication control card such as a LAN card.

According to the present embodiment, control section 101 exchanges various data with second image forming apparatus 200 via communication section 171. Also, control section 101 controls operation of second image forming apparatus 200 in conjunction with control section 201 of second image forming apparatus 200.

Document reading section 110 optically scans a document conveyed onto contact glass, focuses light reflected from the document on a light-receiving surface of a CCD (Charge Coupled Device) sensor, and reads the document. Note that the document is conveyed onto the contact glass by an automatic document feeder (ADF), but the document may be put on the contact glass by manual operation.

Operation/display section 120 is made up, for example, of a liquid crystal display (LCD) with a touch panel and functions as a display section and an operation section. Based on a display control signal inputted from control section 101, the display section displays various operation screens, states of images, operating status of each function, and the like. The operation section is equipped with various operation keys such as a numeric keypad and start key, accepts various input operations from a user, and outputs an operation signal to control section 101.

Image processing section 130 includes a circuit adapted to perform an analog-digital (A/D) conversion process and a circuit adapted to perform digital image processing. Image processing section 130 generates digital image data by A/D conversion process from analog image signal acquired by a CCD sensor of document reading section 110 and outputs the digital image data to image forming section 140. Also, image processing section 130 makes a tone correction based on tone correction data (tone correction table LUT) in storage section 172 under the control of control section 101. Also, in addition to the tone correction, image processing section 130 applies various correction processes such as color correction and shading correction as well as a compression process to input image data. Image forming section 140 is controlled based on the image data subjected to these processes.

Based on the digital image data generated by image processing section 130, image forming section 140 emits laser light, irradiates a photoconductor drum with the emitted laser light, and thereby forms an electrostatic latent image on the photoconductor drum (exposure step).

Image forming section 140 has a configuration for performing a charging step, the exposure step described above, a developing step, a transfer step, and a cleaning step in the order mentioned.

In the charging step, image forming section 140 uniformly charges a surface of the photoconductor drum using corona discharge from a charging apparatus. In the developing step, image forming section 140 deposits toner contained in a developer in a developing apparatus on the electrostatic latent image on the photoconductor drum and thereby forms a toner image.

In the transfer step, image forming section 140 transfers the toner image on the photoconductor drum onto the sheet conveyed by conveyance section 150. In the cleaning step, image forming section 140 removes any toner remaining on the photoconductor drum after the transfer step.

Fixing section 160 applies heat and pressure to the toner image on the sheet introduced into the fixing nip section (thermal fixing) and thereby fixes the toner image on the sheet (fixing step). Consequently a fixed toner image is formed on the sheet.

Second image forming apparatus 200 includes control section 201, image forming section 210, conveyance section 220, fixing section 230 (second fixing section), communication section 241, and storage section 242. Note that process of the components of second image forming apparatus 200 are similar, respectively, to processes of control section 101, image forming section 140, conveyance section 150, fixing section 160, communication section 171, and storage section 172 of first image forming apparatus 100 described above, and thus description thereof will be omitted here.

[Configurations of Image Forming Sections 140 and 210 and Fixing Sections 160 and 230]

Figure 3:
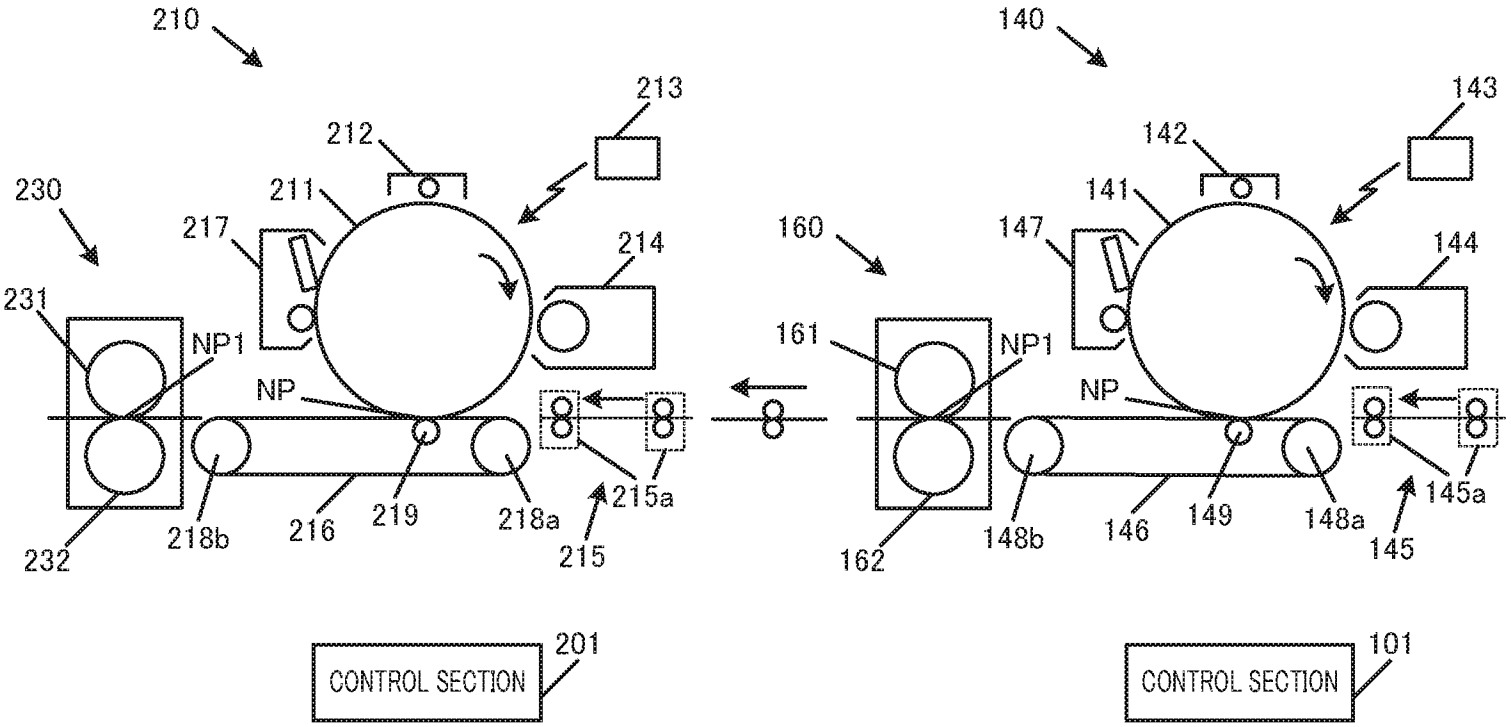
FIG. 3 is diagram showing configurations of an image forming section and fixing section in the image forming system of FIG. 1.

Next, configurations of image forming section 140 and fixing section 160 belonging to first image forming apparatus 100 as well as configurations of image forming section 210 and fixing section 230 belonging to second image forming apparatus 200 will be described with reference to FIG. 3.

Image forming section 140 of first image forming apparatus 100 includes photoconductor drum 141, charging apparatus 142, exposure apparatus 143, developing apparatus 144, transfer/conveyance path 145 adapted to lead the sheet to a transfer region, transfer belt 146 adapted to transfer the toner image formed on photoconductor drum 141 to the sheet, and cleaning apparatus 147 adapted to remove any toner remaining on photoconductor drum 141. In image forming section 140, charging apparatus 142, exposure apparatus 143, developing apparatus 144, transfer/conveyance path 145, transfer belt 146, and cleaning apparatus 147 are provided along a rotational direction (direction of an arrow) of photoconductor drum 141. Transfer/conveyance path 145 makes up part of conveyance section 150 shown in FIG. 2, and plural conveyance roller pairs 145*a* each made up mainly of a driving roller and driven roller are arranged on the transfer/conveyance path 145. Conveyance roller pairs 145*a* are also placed on other conveyance paths of conveyance section 150.

Transfer belt 146 is stretched between driven roller 148*a* and driving roller 148*b* and placed below photoconductor drum 141 such that a surface of transfer belt 146 will be in contact with part of an outer circumferential surface of photoconductor drum 141. That is, transfer nip section NP serving as a transfer region is formed between transfer belt 146 and photoconductor drum 141. The sheet is conveyed by being pressed against photoconductor drum 141 in transfer nip section NP by transfer belt 146.

Transfer roller 149 capable of applying a transfer voltage to transfer belt 146 is placed on an inner side of transfer belt 146 put in contact with part of an outer circumferential surface of photoconductor drum 141. Transfer roller 149 is connected with a voltage application section (not shown) serving as a power supply adapted to apply the transfer voltage to transfer belt 146. Control section 101 controls the voltage to be applied by the voltage application section such that a predetermined current will flow to transfer belt 146 from transfer roller 149. As the transfer voltage is applied to transfer belt 146, the toner image on photoconductor drum 141 is transferred to the sheet placed in contact with photoconductor drum 141.

Also, fixing section 160 is installed downstream of transfer belt 146 in a sheet conveyance direction. Fixing section 160 includes fixing roller 161 (first fixing member) kept at a predetermined heating temperature by a built-in heat source such as a halogen heater and pressure roller 162 (first pressing member) brought into pressing contact with fixing roller 161. Fixing section 160 introduces the sheet into fixing nip section NP1 (first fixing nip) between fixing roller 161 and pressure roller 162, conveys the sheet by nipping the sheet, and thereby thermally fixes the unfixed toner image on the sheet using heat of fixing roller 161.

In fixing section 160, fixing roller 161 has, for example, a diameter of 70 mm and a rubber layer 6.5 mm thick on an outer circumferential side. An outer circumferential surface of the rubber layer is covered with a PFA tube resin layer for use as a surface release layer.

Pressure roller 162 is brought into pressing contact with fixing roller 161 under a predetermined fixing load. The fixing load can be adjusted by installing a known load varying mechanism (see Japanese Patent Application Laid-Open No. 2003-287932) equipped, for example, with a stepping motor, cam, and the like on pressure roller 162 and controlling the stepping motor by control section 101.

Also, different values of the fixing load are used depending on the sheet type and basis weight of the sheet to be used. For example, in the case of a normal sheet uniform in sheet thickness, a fixing load of 700 N is used for a quality sheet and a plain sheet with a basis weight of less than 50 g/m$^2$, a fixing load of 1100 N is used for a quality sheet with a basis weight of 50 to 74 g/m$^2$, a fixing load of 1900 N is used for a plain sheet with a basis weight of 50 to 74 g/m$^2$, and a fixing load of 1900 N is used for a quality sheet and a plain sheet with a basis weight of 75 g/m$^2$.

Image forming section 210 of second image forming apparatus 200 includes photoconductor drum 211, charging apparatus 212, exposure apparatus 213, developing apparatus 214, transfer/conveyance path 215 adapted to lead the sheet to a transfer region, transfer belt 216 adapted to transfer the toner image formed on photoconductor drum 211 to the sheet, and cleaning apparatus 217 adapted to remove any toner remaining on photoconductor drum 211. In image forming section 210 charging apparatus 212, exposure apparatus 213, developing apparatus 214, transfer/conveyance path 215, transfer belt 216, and cleaning apparatus 217 are provided along a rotational direction (direction of an arrow) of photoconductor drum 211. Transfer/conveyance path 215 makes up part of conveyance section 220 shown in FIG. 2, and plural conveyance roller pairs 215*a* each made up mainly of a driving roller and driven roller are arranged on the transfer/conveyance path 215. Conveyance roller pairs 215*a* are also placed on other conveyance paths of conveyance section 220.

Transfer belt 216 is stretched between driven roller 218*a* and driving roller 218*b* and placed below photoconductor drum 211 such that a surface of transfer belt 216 will be in contact with part of an outer circumferential surface of photoconductor drum 211. That is, transfer nip section NP serving as a transfer region is formed between transfer belt 216 and photoconductor drum 211. The sheet is conveyed by being pressed against photoconductor drum 211 in transfer nip section NP by transfer belt 216.

Transfer roller 219 capable of applying a transfer voltage to transfer belt 216 is placed on an inner side of transfer belt 216 put in contact with part of an outer circumferential surface of photoconductor drum 211. Transfer roller 219 is connected with a voltage application section (not shown) serving as a power supply adapted to apply the transfer voltage to transfer belt 216. Control section 201 controls the voltage to be applied by the voltage application section such that a predetermined current will flow to transfer belt 216 from transfer roller 219. As the transfer voltage is applied to transfer belt 216, the toner image on photoconductor drum 211 is transferred to the sheet placed in contact with photoconductor drum 211.

Also, fixing section 230 is installed downstream of transfer belt 216 in the sheet conveyance direction. Fixing section 230 includes fixing roller 231 (second fixing member) kept at a predetermined heating temperature by a built-in heat source such as a halogen heater and pressure roller 232 (second pressing member) brought into pressing contact with fixing roller 231. Fixing section 230 introduces the sheet into fixing nip section NP1 (second fixing nip) between fixing roller 231 and pressure roller 232, conveys the sheet by nipping the sheet, and thereby thermally fixes the unfixed toner image on the sheet using heat of fixing roller 231.

In fixing section 230, pressure roller 232 is brought into pressing contact with fixing roller 231 under a predetermined fixing load. The fixing load can be adjusted using a mechanism and control similar to those described above.

Whereas in the present embodiment, a configuration of a heating roller type such as described above has been shown by example as fixing sections 160 and 230, another configuration such as a heating belt type may be used alternatively. Also, the heat sources of fixing sections 160 and 230 may be an IH (induction heating) type.

Now, if a printing process similar to the one used for the above-mentioned normal sheet is used on image forming system 10 of the above configuration in forming images on a partially thickened sheet (sheet nonuniform in sheet thickness) such as a chip-embedded sheet rather than sheet uniform in sheet thickness, problems arise in terms of durability of fixing members during the fixing process. Now, a configuration of the chip-embedded sheet as well as problems encountered in forming images on the chip-embedded sheet will be described with reference to FIG. 4.

Figure 4:
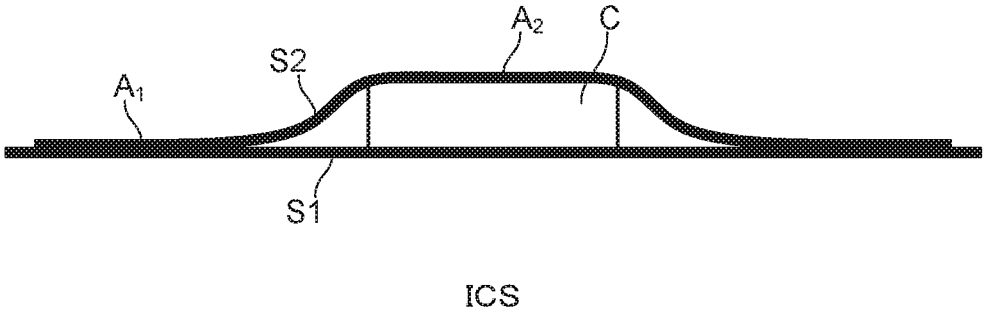
FIG. 4 is a partial sectional view explaining a configuration of a chip-embedded sheet.

A cross-sectional shape of a chip-embedded sheet ICS is shown in FIG. 4. As shown in FIG. 4, chip-embedded sheet ICS is a recording material made up of two sheets S1 and S2 with IC chip C provided therebetween. Chip-embedded sheet ICS includes thin-sheet section $A_1$ as a first region containing no IC chip C and having a small sheet thickness and thick-sheet section $A_2$ as a second region containing IC chip C and having a large sheet thickness. An adhesive (not shown) is interposed between sheet S1 and sheet S2 of chip-embedded sheet ICS.

In chip-embedded sheet ICS, the sheet thickness of thin-sheet section $A_1$ is, for example, around 200 μm and the sheet thickness of thick-sheet section $A_2$ is, for example, around 500 μm. Depending on the thickness and the like of IC chip C, the sheet thickness of thick-sheet section $A_2$ in chip-embedded sheet ICS is generally 1.5 to 3 times the sheet thickness of thin-sheet section $A_1$.

Regarding the configuration of chip-embedded sheet ICS, only a single IC chip C is shown in FIG. 4, but actually plural IC chips C may be arranged. In the case of chip-embedded sheet equipped with plural IC chips, the IC chips may be arranged in any desired form and may be equal to one another or different from one another in size or thickness.

With respect to chip-embedded sheet ICS, which is partially thickened sheet nonuniform in sheet thickness as described above, if fixing sections 160 and 230 perform a fixing process using normal fixing pressure (fixing load) used for a normal sheet uniform in sheet thickness, surface pressure will rise in a portion with a large sheet thickness, overloading fixing rollers 161 and 231 as well as pressure rollers 162 and 232 and thereby giving rise to a problem of reduced durability of the rollers.

As a means of dealing with the problem of durability, it is conceivable to perform the fixing process using a smaller fixing load than for a normal sheet. However, if the fixing load is reduced, although fixability can be ensured in thick-sheet section $A_2$ of chip-embedded sheet ICS by the nip surface pressure increased during passage of the sheet because of a large sheet thickness, fixability cannot be ensured in thin-sheet section $A_1$ because of low nip surface pressure.

To deal with this problem, according to the present embodiment, in printing a toner image on chip-embedded sheet ICS, that part of the image which is intended for thin-sheet section $A_1$ (first region) is formed and fixed by first image forming apparatus 100 and that part of the image which is intended for thick-sheet section $A_2$ (second region) is formed and fixed by second image forming apparatus 200. Moreover, in printing a toner image on chip-embedded sheet ICS, respective fixing sections 160 and 230 of first and second image forming apparatuses 100 and 200 pass chip-embedded sheet ICS using a lower fixing load (second load) than the fixing load (first load) used for a sheet uniform in sheet thickness.

More specifically, in printing a toner image on chip-embedded sheet ICS, of the fixing loads, the second load is set to a value 25 to 45% lower than the first load. Also, in printing a toner image on chip-embedded sheet ICS, regardless of whether or not a toner image is formed, i.e., even when a toner image is formed only by either of first image forming apparatus 100 and second image forming apparatus 200, the second load is used as the fixing load. Also, in printing a toner image on chip-embedded sheet ICS, a single-side mode in which an image is formed only on one side (upper side or lower side in FIG. 4) of chip-embedded sheet ICS is established, disabling the use of reversal mechanism R1 adapted to reverse the front and back sides of the sheet.

When forming images on a partially thickened sheet such as chip-embedded sheet ICS, this configuration makes it possible to ensure good fixability and ensure durability of members (fixing rollers 161 and 231 as well as pressure rollers 162 and 232) forming fixing nip NP1.

That is, according to the present embodiment, in printing a toner image on chip-embedded sheet ICS, first, a toner image is formed on thin-sheet section $A_1$ not containing IC chip C by image forming section 140 of first image forming apparatus 100, which is an upstream apparatus, and the sheet is passed by setting the fixing load of fixing section 160 to the second load lower than normal. Next, a toner image is formed on thick-sheet section $A_2$ containing IC chip C by image forming section 210 of second image forming apparatus 200, which is a downstream apparatus, and the sheet is passed by setting the fixing load of fixing section 230 to the second load lower than normal.

In this operation, regarding thick-sheet section $A_2$ containing IC chip C, even if the fixing load is the second load lower than normal, the nip surface pressure increases during passage of the sheet in fixing section 230 because of the large sheet thickness, making it possible to ensure fixability. On the other hand, regarding thin-sheet section $A_1$ having a small sheet thickness, after a toner image is formed by image forming section 140 of first image forming apparatus 100, since the fixing process is performed twice by fixing section 160 and by fixing section 230 of second image forming apparatus 200, fixability can be ensured even if the fixing load of both fixing sections 160 and 230 is the second load.

Therefore, the present embodiment can ensure good fixability and ensure the durability of the members forming fixing nip NP1, making it possible to combine good fixability with ensured durability of fixing rollers 161 and 231 and pressure rollers 162 and 232.

Note that if the sequence of image formation is changed, i.e., if a toner image is formed on thick-sheet section $A_2$ by first image forming apparatus 100 (upstream apparatus) and a toner image is formed on thin-sheet section $A_1$ by second image forming apparatus 200 (downstream apparatus), the effect described above is no longer available.

Specifically, in this case, thick-sheet section $A_2$ is passed through fixing sections 160 and 230, and the respective nip surface pressures of the fixing sections increase, thereby allowing fixability of the toner image to be ensured, but because thin-sheet section $A_1$ is passed through fixing section 230 only once after formation of the toner image, the fixability of the toner image cannot be ensured. Here, it is conceivable to set the fixing load of only fixing section 230 of the downstream apparatus higher than the second load. In that case, however, even though the fixability of the toner image on thin-sheet section $A_1$ can be ensured, the durability of fixing roller 231 and pressure roller 232 of fixing section 230 is reduced.

Therefore, the configuration described above makes it possible to combine good fixability of the toner image formed on thin-sheet section $A_1$ and thick-sheet section $A_2$ with ensured durability of fixing rollers 161 and 231 and pressure rollers 162 and 232.

According to the present embodiment, when chip-embedded sheet ICS is used as a sheet, a non-illustrated sheet-profile setting screen is displayed on operation/display section 120, allowing the user to register the sheet size of chip-embedded sheet ICS, the location of thick-sheet section $A_2$ on the sheet, and the like as user-defined information on the setting screen in advance.

Figure 5:
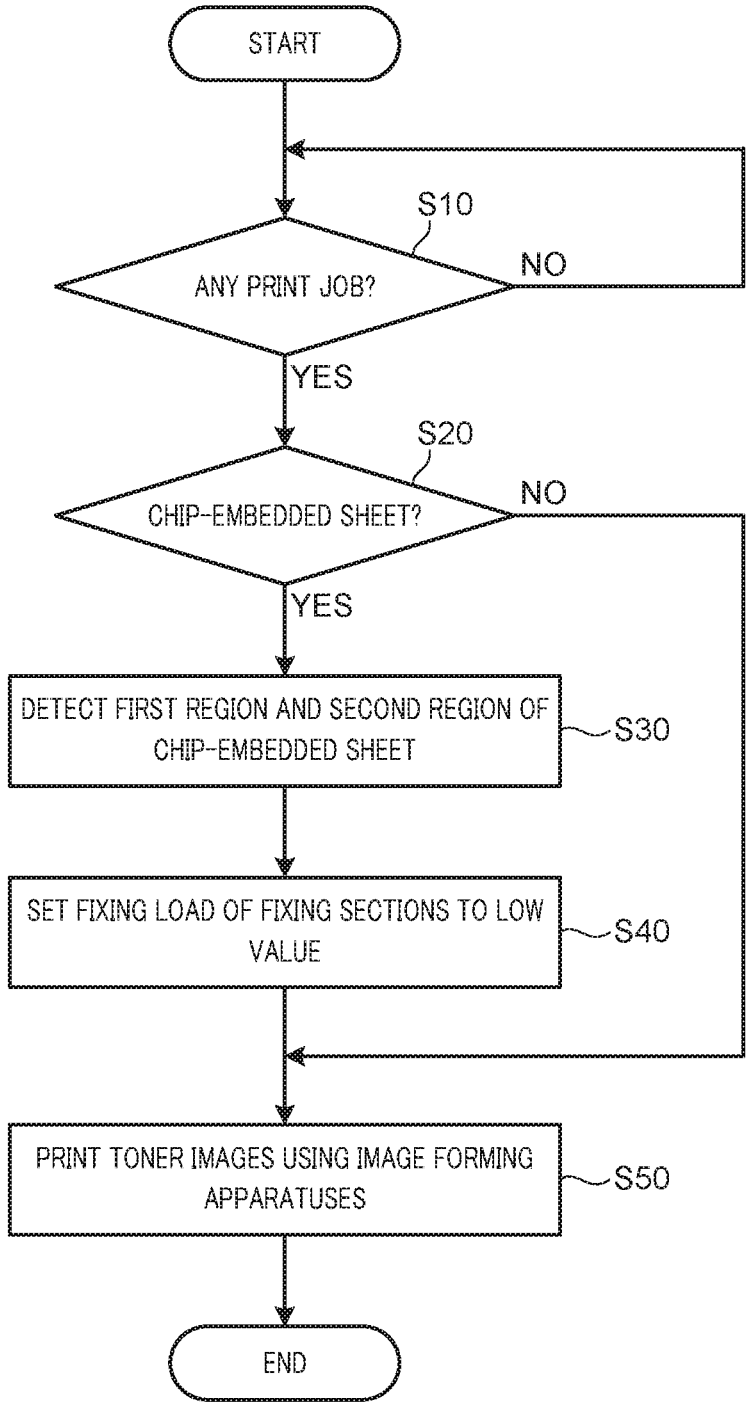
FIG. 5 is a flowchart explaining a processing flow for forming an image on a chip-embedded sheet in the image forming system of FIG. 1.

A processing flow of a print job executed by image forming system 10 using chip-embedded sheet ICS will be described below with reference to a flowchart of FIG. 5.

In Step S10, control section 101 of first image forming apparatus 100 waits until a print job is received, and when a print job is received (YES in Step S10), control section 101 goes to Step S20.

In Step S20, control section 101 determines with reference to details of the print job whether the sheet to be used is a chip-embedded sheet, and when the sheet to be used is a chip-embedded sheet (YES in Step S20), control section 101 goes to Step S30. On the other hand, when the sheet to be used is not a chip-embedded sheet (NO in Step S20), control section 101 skips to Step S50, regarding that the sheet to be used is a sheet uniform in sheet thickness.

In Step S30, control section 101 detects positions of thin-sheet section $A_1$ and thick-sheet section $A_2$ based on the user-defined information described above, where thin-sheet section $A_1$ and thick-sheet section $A_2$ are the first region and second region of a chip-embedded sheet to be used, respectively.

In Step S40, control section 101 sets the fixing load of respective fixing sections 160 and 230 of image forming apparatuses 100 and 200 to a low value (second load). The value of the second load is set 25 to 45% lower than a normal load, i.e., the first load used for a sheet uniform in sheet thickness as described above. According to the present embodiment, the second load set in Step S40 is identical between fixing sections 160 and 230. As another example of settings, the fixing loads used in respective fixing sections 160 and 230 may be set to values different from each other as long as the second load is lower than the first load described above.

In Step S50, control section 101 controls image forming sections 140 and 210, fixing sections 160 and 230, and the like such that image forming apparatuses 100 and 200 will perform respective printing processes.

Specifically, to print a toner image on chip-embedded sheet ICS in Step S50, by referring to input image data, control section 101 controls image forming section 140 and fixing section 160 such that first image forming apparatus 100 will print the toner image on thin-sheet section $A_1$, which is the first region. Here, even if no toner image is formed on thin-sheet section $A_1$ by image forming section 140 (i.e., even if an image forming step is not carried out), a fixing step (i.e., heating under pressure exerted by the second load) is carried out by fixing section 160.

Next, control section 101 performs control such that chip-embedded sheet ICS described above will be conveyed to second image forming apparatus 200 and controls image forming section 210 and fixing section 230 such that a toner image will be printed by second image forming apparatus 200 on thick-sheet section $A_2$, which is the second region. Alternatively, control section 101 sends instructions to control section 201, specifying a toner image to be printed on thick-sheet section $A_2$ by image forming section 210 and fixing section 230 of second image forming apparatus 200. Here, even if no toner image is formed on thick-sheet section $A_2$ by image forming section 210 (i.e., even if an image forming step is not carried out), a fixing step (i.e., heating under pressure exerted by the second load) is carried out by fixing section 230.

The above process makes it possible to ensure good fixability in forming an image on chip-embedded sheet ICS as well as ensure the durability of the fixing members (fixing rollers 161 and 231, pressure rollers 162 and 232, and the like) forming fixing nip NP1.

On the other hand, to print a toner image on a sheet other than chip-embedded sheet ICS in Step S50, based on the print job and input image data, control section 101 controls various part such that the input image will be printed and a sheet will be conveyed according to the print job.

Embodiment 2

Next, Embodiment 2 in which an image is formed on chip-embedded sheet ICS will be described with reference to FIG. 6 to FIG. 8.

Figure 6:
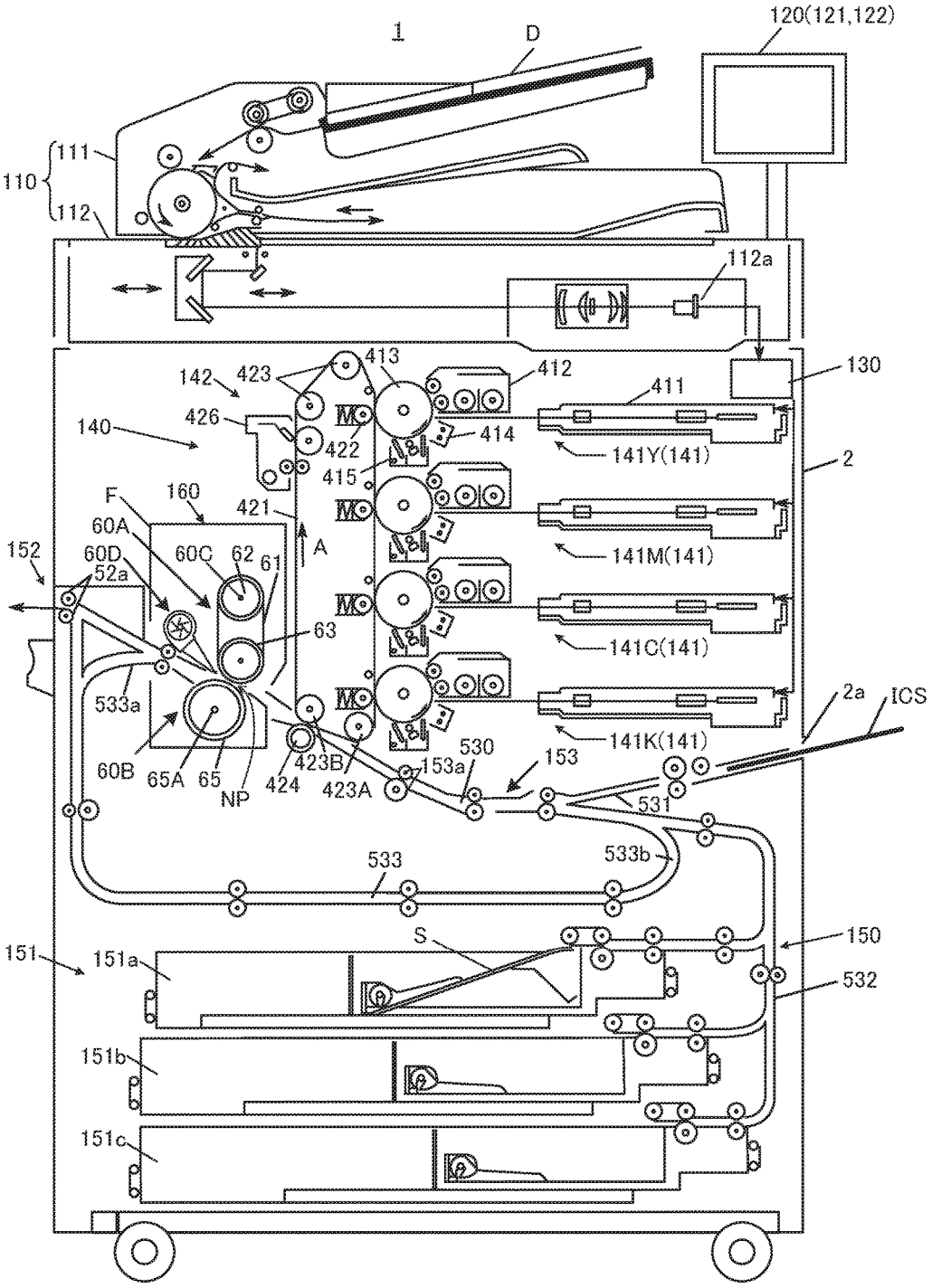
FIG. 6 shows an overall configuration of an image forming apparatus according to Embodiment 2.
Figure 7:
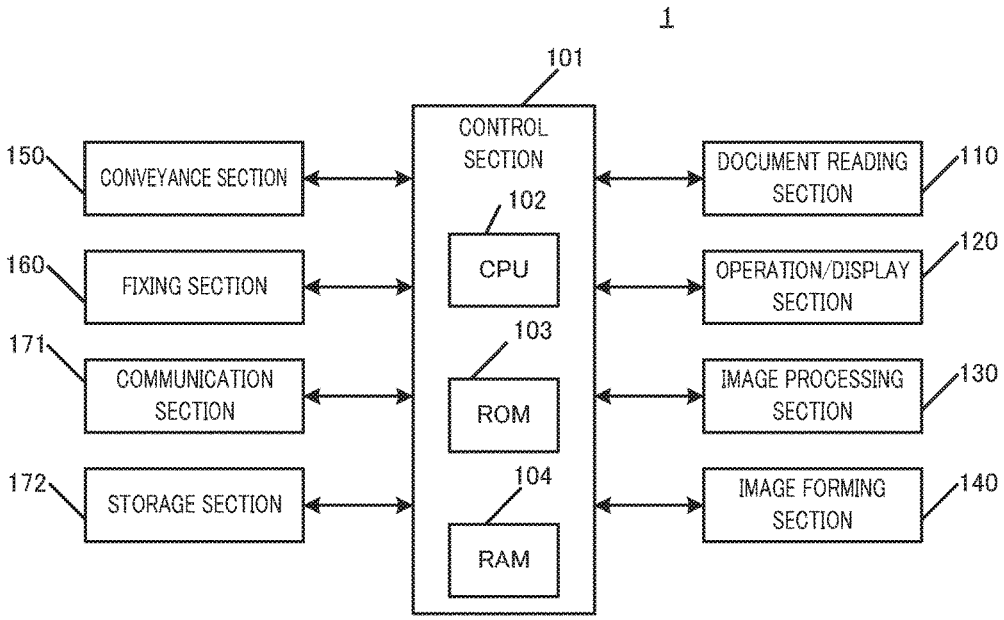
FIG. 7 is a functional block diagram of the image forming apparatus of FIG. 6.
Figure 8:
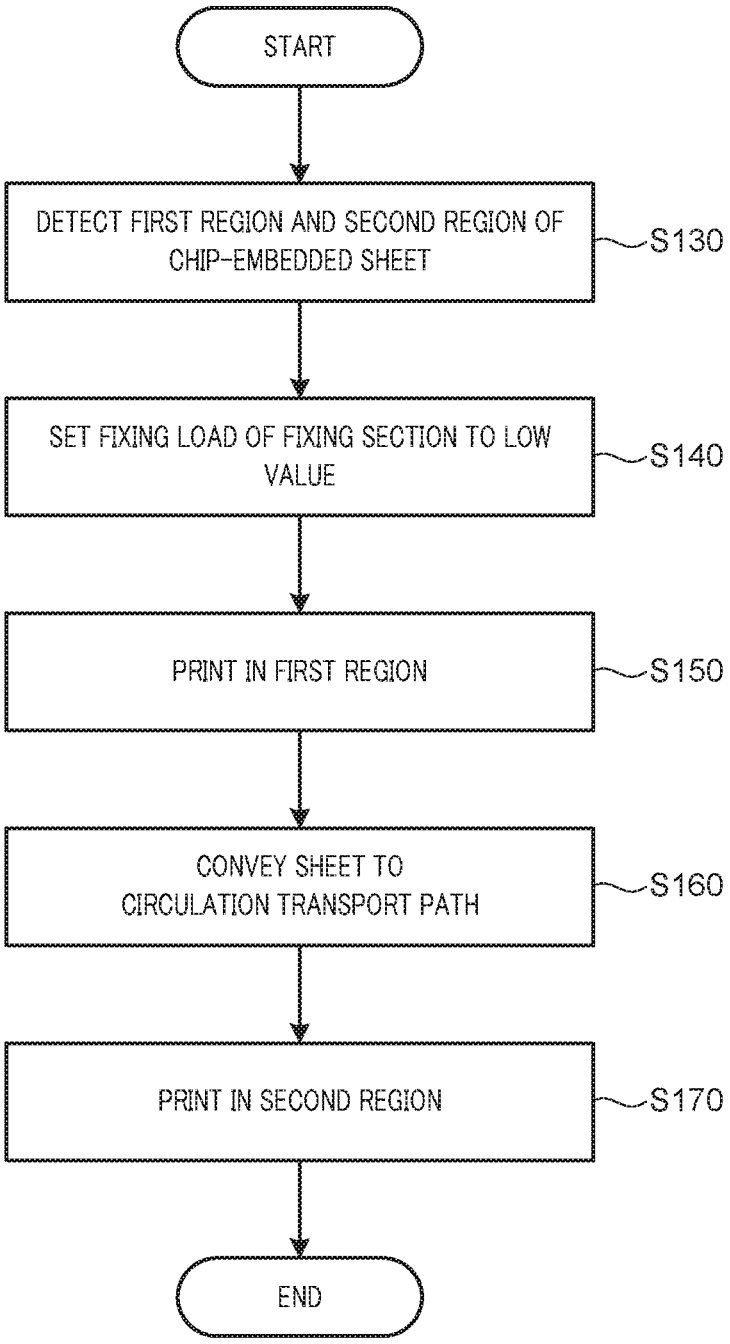
FIG. 8 is a flowchart explaining a processing flow for forming an image on a chip-embedded sheet in the image forming apparatus of FIG. 6.

FIG. 6 schematically shows an overall configuration of image forming apparatus 1 according to Embodiment 2; and FIG. 7 shows principal components of a control system of image forming apparatus 1. For the sake of simplicity, components equal in configuration to first image forming apparatus 100 of image forming system 10 described above are denoted below by the same reference numerals as the corresponding components of first image forming apparatus 100, and description thereof will be omitted as appropriate.

As shown in FIG. 6, image forming apparatus 1 is an intermediate-transfer color image forming apparatus using electrophotographic technology. That is, image forming apparatus 1 primarily transfers Y (yellow), M (magenta), C (cyan), and K (black) toner images formed on photoconductor drums 413 to intermediate transfer belt 421, superimposes the toner images of four colors one on top of another on intermediate transfer belt 421, then secondarily transfers the toner images onto sheet S sent out from sheet feed units 51*a* to 51*c*, and thereby forms an image.

Image forming apparatus 1 adopts a tandem system in which photoconductor drums 413 corresponding to the four YMCK colors are arranged in series along a running direction of intermediate transfer belt 421 and the images of the different colors are transferred to intermediate transfer belt 421 in sequence in a single procedure.

As shown in FIG. 6 and FIG. 7, image forming apparatus 1 is an MFP (Multi Function Peripheral) that includes document reading section 110, operation/display section 120, image processing section 130, image forming section 140, sheet conveyance section 150, fixing section 160, control section 101, communication section 171, storage section 172, and the like.

Document reading section 110 includes automatic document feeding apparatus 111 also known as ADF (Auto Document Feeder), original-image scanning apparatus 112 (scanner), and the like.

Automatic document feeding apparatus 111 conveys document D placed on a document tray using a conveyance mechanism and thereby delivers document D to original-image scanning apparatus 112. Automatic document feeding apparatus 111 makes it possible to read a large number of documents D (including duplex mode) placed on the document tray, consecutively in one go.

Original-image scanning apparatus 112 optically scans a document conveyed onto the contact glass from automatic document feeding apparatus 111 or a document put on the contact glass, focuses light reflected from the document on the light-receiving surface of a CCD (Charge Coupled Device) sensor 112*a*, and reads an original image. Document reading section 110 generates input image data based on read results produced by original-image scanning apparatus 112. The input image data undergoes predetermined image processing performed by image processing section 130.

Operation/display section 120 is made up, for example, of a liquid crystal display with a touch panel and functions as display section 121 and operation section 122.

Image processing section 130 includes a circuit and the like adapted to perform digital image processing on input image data according to default settings or user settings.

Image forming section 140 includes image forming units 141Y, 141M, 141C, and 141K adapted to form images using Y, M, C, and K color toners based on input image data as well as includes intermediate transfer unit 142 and the like.

The image forming units 141Y, 141M, 141C, and 141K for Y, M, C, and K colors have similar configurations. For convenience of illustration and explanation, similar components are denoted by the same reference numerals and Y, M, C, or K are added to the reference numerals only when it is necessary to distinguish among components for different colors. In FIG. 6, only the components of the image forming unit 141Y for the Y color are denoted by reference numerals, and the reference numerals of the components of the other image forming units 141M, 141C, and 141K are omitted.

Each image forming unit 141 includes exposure apparatus 411, developing apparatus 412, photoconductor drum 413, charging apparatus 414, drum cleaning apparatus 415, and the like.

Photoconductor drum 413 is a negatively-charged organic photo-conductor (OPC) created by laminating an under coat layer (UCL), a charge generation layer (CGL), and a charge transport layer (CTL) in sequence on a circumferential surface of, for example, a conductive cylindrical aluminum body (aluminum pipe stock). The charge generation layer is made of an organic semiconductor produced by scattering a charge generation material (e.g., phthalocyanine pigment) in a resin binder (e.g., polycarbonate) and generates a pair of positive and negative charges when exposed by exposure apparatus 411. The charge transport layer is produced by scattering a positive-hole transport material (electron-donating nitrogen-containing compound) in a resin binder (e.g., polycarbonate resin) and conveys positive charges generated in the charge generation layer to a surface of the charge transport layer.

Control section 101 controls a driving current supplied to a drive motor (not shown) adapted to rotate each photoconductor drum 413, and thereby rotates the photoconductor drum 413 at a constant circumferential speed (linear velocity).

Charging apparatuses 414 impart uniformly negative charges to surfaces of respective photoconductor drums 413 having photoconductivity. Exposure apparatuses 411 are made up, for example, of semiconductor lasers and irradiate photoconductor drums 413 with laser beams corresponding to respective color components of the image. A positive charge is generated in the charge generation layer of each photoconductor drum 413, conveyed to the surface of the charge transport layer, thereby neutralizing a surface charge (negative charge) of photoconductor drum 413. An electrostatic latent image of the corresponding color component is formed on the surface of each photoconductor drum 413 due to a potential difference from surroundings.

Developing apparatuses 412, which are, for example, two-component developing apparatuses, deposit toners of respective colors on the surfaces of photoconductor drums 413, thereby visualize electrostatic latent images, and form toner images.

Each drum cleaning apparatus 415 includes a cleaning blade and the like, where the cleaning blade is placed in sliding contact with the surface of photoconductor drum 413. Drum cleaning apparatus 415 removes residual toner remaining on the surface of photoconductor drum 413 after primary transfer using the cleaning blade.

Intermediate transfer unit 142 includes intermediate transfer belt 421 serving as an image carrier, primary transfer roller 422, plural support rollers 423, secondary transfer roller 424, belt cleaning apparatus 426, and the like.

Intermediate transfer belt 421 is an endless belt and is stretched over plural support rollers 423, forming a loop. At least one of plural support rollers 423 is a driving roller, and the other rollers are driven rollers. Preferably, for example, roller 423A placed downstream of primary transfer roller 422 for the K color in a belt running direction is a driving roller. This makes it easy to keep belt running speed in a primary transfer section constant. As driving roller 423A rotates, intermediate transfer belt 421 runs at a constant speed in the direction of arrow A.

Primary transfer roller 422 is placed on an inner circumferential side of intermediate transfer belt 421, facing photoconductor drums 413 for the respective colors. Primary transfer roller 422 is brought into pressing contact with photoconductor drums 413 with intermediate transfer belt 421 pinched therebetween, thereby forming a primary transfer nip used to transfer toner images from photoconductor drums 413 to intermediate transfer belt 421.

Secondary transfer roller 424 is placed on an outer circumferential side of intermediate transfer belt 421, facing backup roller 423B placed downstream of driving roller 423A in the belt running direction. Secondary transfer roller 424 is brought into pressing contact with backup roller 423B with intermediate transfer belt 421 pinched therebetween, thereby forming a secondary transfer nip used to transfer toner images from intermediate transfer belt 421 to the sheet.

When intermediate transfer belt 421 passes through the primary transfer nip, toner images on photoconductor drums 413 are primarily transferred in sequence onto intermediate transfer belt 421, being superimposed one on top of another. Specifically, primary transfer bias is applied to primary transfer roller 422 and a charge opposite in polarity to the toner is applied to a back side of intermediate transfer belt 421 (side on which intermediate transfer belt 421 abuts primary transfer roller 422), thereby electrostatically transferring the toner images onto intermediate transfer belt 421.

Subsequently, when the sheet passes through the secondary transfer nip, the toner images on intermediate transfer belt 421 are secondarily transferred to the sheet. Specifically, secondary transfer bias is applied to secondary transfer roller 424 and a charge opposite in polarity to the toner is applied to a back side of the sheet (side on which the sheet abuts secondary transfer roller 424), thereby electrostatically transferring the toner images onto the sheet. The sheet with the toner images transferred thereto is conveyed toward fixing section 160.

Belt cleaning apparatus 426 includes a belt cleaning blade and the like, the belt cleaning blade being placed in sliding contact with a surface of intermediate transfer belt 421, and removes residual toner remaining on the surface of intermediate transfer belt 421 after secondary transfer. Note that instead of secondary transfer roller 424, a configuration (so-called belt-type secondary transfer unit) may be adopted in which an intermediate transfer belt is stretched in a loop over plural support rollers including a secondary transfer roller.

Fixing section 160 includes upper fixing section 60A provided with a fixing-surface-side member placed on the side of a fixing surface (surface on which toner images are formed) of the sheet, lower fixing section 60B provided with a back-side support member placed on the back side (side opposite the fixing surface) of the sheet, heating source 60C, and the like. The back-side support member is brought into pressing contact with the fixing-surface-side member, thereby forming a fixing nip configured to nip and convey the sheet.

With the toner images secondarily transferred, fixing section 160 heats and pressurizes the incoming sheet in the fixing nip and thereby fixes the toner images on the sheet. The fixing section 160 is installed as a unit in fuser F. Also, pneumatic separation unit 60D adapted to separate sheet S from the fixing-surface-side member by blowing air is installed in fuser F.

Upper fixing section 60A includes endless fixing belt 61, which is a fixing-surface-side member, heating roller 62, and upper pressure roller 63 (belt heating type). Fixing belt 61 is stretched over heating roller 62 and upper pressure roller 63 at a predetermined tension (e.g., 400 N).

Fixing belt 61 is produced by covering an outer circumferential surface of a base made, for example, of PI (polyimide) with a heat-resistant silicon rubber for use as an elastic layer and further covering or coating a surface layer with a tube of PFA (perfluoroalkoxy) which is a heat-resistant resin.

Fixing belt 61 comes into contact with the sheet on which toner images have been formed and thermally fixes the toner images on the sheet within a permissible fixing-temperature range. Here, a permissible fixing-temperature range is a temperature range in which an amount of heat needed to melt the toner on the sheet can be supplied and varies with the type of sheet used for image formation and the like.

Heating roller 62 heats fixing belt 61. Heating roller 62 incorporates heating source 60C adapted to heat fixing belt 61. Heating roller 62 is, for example, a halogen heater and is covered with a resin layer produced by coating an outer circumferential surface of a cylindrical metal core formed of aluminum or the like with PTFE.

The temperature of heating source 60C is controlled by control section 101. Heating roller 62 is heated by heating source 60C, consequently heating fixing belt 61.

Upper pressure roller 63 is produced by covering a solid metal core formed, for example, of metal such as iron with a heat-resistant silicon rubber for use as an elastic layer and further with a resin layer coated with PTFE, which is a low-friction, heat-resistant resin. Upper pressure roller 63 is brought into pressing contact with lower pressure roller 65 via fixing belt 61, where lower pressure roller 65 is driven and rotated by main drive source (not shown) in fixing section 160.

Lower fixing section 60B includes lower pressure roller 65, which is, for example, a back-side support member (roller pressurizing type). Lower pressure roller 65 is produced by covering an outer circumferential surface of a base material layer made, for example, of PI (polyimide) with a heat-resistant silicon rubber for use as an elastic layer and further covering an outer circumferential surface of the elastic layer with a PFA tube resin layer for use as a surface release layer.

By controlling the main drive source (drive motor), control section 101 rotates lower pressure roller 65 in a counterclockwise direction in FIG. 6. The drive control (e.g., on/off of rotation, circumferential speed, etc.) of the drive motor is performed by control section 101.

Lower pressure roller 65 incorporates heating source 65A such as a halogen heater. When heating source 65A generates heat, lower pressure roller 65 is heated. Control section 101 controls electric power supplied to heating source 65A and thereby keeps lower pressure roller 65 at a predetermined temperature.

Lower pressure roller 65 is brought into pressing contact with upper pressure roller 63 under a predetermined fixing load via fixing belt 61. The fixing load can be adjusted in the same manner as described above by installing a known load varying mechanism equipped, for example, with a stepping motor, cam, and the like on lower pressure roller 65 and controlling the stepping motor by control section 101. In this way, fixing nip NP1 configured to nip and convey the sheet is formed between upper pressure roller 63 and lower pressure roller 65 via fixing belt 61.

Conveyance section 150 includes sheet feed section 151, sheet output section 152, conveyance path segment 153, and the like. Sheet S (standard sheet, special sheet) identified based on the basis weight (stiffness), size, and the like are housed in three sheet feed units 51*a* to 51*c* of sheet feed section 151 by being sorted according to types set in advance. Conveyance path segment 153 includes plural conveyance rollers including a resist roller pair 153*a*, a duplex conveyance path used to form images on both sides of a sheet, and the like. Note that details of conveyance path segment 153 will be described later.

In a simplex print mode for printing on one side of a sheet, sheet S stored in sheet feed units 151*a* to 151*c* is sent out sheet by sheet from the top and is conveyed to image forming section 140 by conveyance path segment 153. In so doing, any slant of fed sheet S is corrected and conveyance timing is adjusted by a resist roller section in which resist roller pair 153*a* is disposed. Then, in image forming section 140, the toner images on intermediate transfer belt 421 are secondarily transferred all together to one side of sheet S, and a fixing step is carried out by fixing section 160. Sheet S with the image formed thereon is ejected out of the apparatus by sheet output section 152 equipped with sheet output rollers 52*a*.

On the other hand, when printing toner images on chip-embedded sheet ICS described above, as shown in FIG. 6, chip-embedded sheet ICS is fed through external sheet feed slot 2*a* in apparatus body 2. Also, when printing toner images on chip-embedded sheet ICS, control section 101 performs control such that chip-embedded sheet ICS will be passed through image forming section 140 and fixing section 160 in simplex print mode twice. Details of this control will be described later.

Next, conveyance path segment 153 will be described.

Conveyance path segment 153 is a path along which sheet is conveyed when an image is formed on one side, and includes a main conveyance path 530 along which the sheet used for image formation in image forming section 140 is conveyed. Main conveyance path 530 conveys the sheet through resist roller pair 153*a*, the secondary transfer nip of image forming section 140, and fixing section 160. Also, conveyance path segment 153 includes circulation conveyance path 533 to convey the sheet on which toner images have been printed to image forming section 140 again.

Conveyance path segment 153 includes external sheet feed/conveyance path 531 adapted to convey a sheet such as chip-embedded sheet ICS fed through external sheet feed slot 2*a* to main conveyance path 530, sheet feed/conveyance path 532 adapted to convey sheet S fed from sheet feed units 151*a* to 151*c* to main conveyance path 530.

Main conveyance path 530 is installed above sheet feed units 151*a* to 151*c* in apparatus body 2, extending from one lateral side to another lateral side of apparatus body 2. Main conveyance path 530 is connected at a first end to external sheet feed/conveyance path 531 and sheet feed/conveyance path 532. Main conveyance path 530 is connected at a second end to an ejection slot of sheet output section 152 provided in the other lateral side of apparatus body 2.

External sheet feed/conveyance path 531 is connected at a first end to external sheet feed slot 2*a* and connected at a second end to main conveyance path 530. Sheet feed/conveyance path 532 is installed near one lateral side in apparatus body 2, extending in an up-and-down (substantially vertical) direction from sheet feed units 151*a* to 151*c* to main conveyance path 530. Sheet feed/conveyance path 532 is connected at an upper end to main conveyance path 530 and connected at a lower end to sheet feed units 151*a* to 151*c*.

As shown in FIG. 6, circulation conveyance path 533 is a substantially C-shaped conveyance path installed between sheet feed units 151*a* to 151*c* and main conveyance path 530 in apparatus body 2 and provided with plural roller pairs for use to convey the sheet.

On an upstream side in the sheet conveyance direction, circulation conveyance path 533 includes branch conveyance path 533*a* branching off from main conveyance path 530. In the conveyance direction of the sheet conveyed on main conveyance path 530, branch conveyance path 533*a* is installed on a downstream side of fixing section 160, branching downward from main conveyance path 530.

On the most downstream side in the sheet conveyance direction, circulation conveyance path 533 includes merging conveyance path 533*b* merging into main conveyance path 530. Merging conveyance path 533*b* is installed so as to merge into main conveyance path 530 at a location upstream of the secondary transfer nip of image forming section 140.

Image forming apparatus 1 equipped with circulation conveyance path 533 described above can print toner images multiple times on the same side of the sheet by conveying the sheet on which toner images have been printed by image forming section 140 and fixing section 160 to circulation conveyance path 533.

Next, the process of printing toner images on chip-embedded sheet ICS will be described with reference to a flowchart of FIG. 8.

In Step S130, control section 101 detects positions of thin-sheet section $A_1$ and thick-sheet section $A_2$ based on the user-defined information described above, where thin-sheet section $A_1$ and thick-sheet section $A_2$ are the first region and second region of chip-embedded sheet ICS to be used, respectively.

In Step S140, control section 101 sets the fixing load of fixing section 160 to a low value (second load). The value of the second load is set 25 to 45% lower than a normal load, i.e., the first load used for a sheet uniform in sheet thickness as described above.

In Step S150, control section 101 controls image forming section 140, fixing section 160, and the like such that a first printing process will be performed on chip-embedded sheet ICS. Specifically, by referring to input image data, control section 101 controls image forming section 140 and fixing section 160 such that toner images will be printed on thin-sheet section $A_1$, which is the first region. Here, even if no toner image is formed on thin-sheet section $A_1$ by image forming section 140 (i.e., even if an image forming step is not carried out), a fixing step (i.e., heating under pressure exerted by the second load) is carried out by fixing section 160.

In Step S160, control section 101 performs conveyance control such that chip-embedded sheet ICS subjected to the first printing process will be conveyed to circulation conveyance path 533. As a result of this control, chip-embedded sheet ICS is sent from fixing section 160 to circulation conveyance path 533 through branch conveyance path 533*a* and fed again from merging conveyance path 533*b* to image forming section 140 through main conveyance path 530.

In Step S170, control section 101 controls image forming section 140, fixing section 160, and the like such that a second printing process will be performed on chip-embedded sheet ICS. Specifically, by referring to the input image data, control section 101 controls image forming section 140 and fixing section 160 such that toner images will be printed on thick-sheet section $A_2$, which is the second region. Here, even if no toner image is formed on thick-sheet section $A_2$ by image forming section 140 (i.e., even if an image forming step is not carried out), a fixing step (i.e., heating under pressure exerted by the second load) is carried out by fixing section 160.

According to the present embodiment, the fixing load applied to fixing section 160 in the second printing process is equal to the fixing load applied to fixing section 160 in the first printing process. As another example, the fixing loads used in the first and second printing processes may differ from each other as long as the second load is lower than the first load described above.

Next, control section 101 performs conveyance control such that chip-embedded sheet ICS subjected to the second printing process will be ejected out of the apparatus through sheet output section 152.

The present embodiment, which performs the control described above, can ensure good fixability in forming an image on chip-embedded sheet ICS as well as ensure the durability of the fixing members (fixing belt 61, upper pressure roller 63, lower pressure roller 65, and the like) forming the fixing nip.

According to the present embodiment, when the first printing process on chip-embedded sheet ICS is finished, control section 101 performs conveyance control of chip-embedded sheet ICS such that chip-embedded sheet ICS will be conveyed for the second printing process to circulation conveyance path 533. As another example, when the first printing process on chip-embedded sheet ICS is finished, control section 101 may perform conveyance control such that chip-embedded sheet ICS will be ejected out of the apparatus through sheet output section 152 and then fed manually into external sheet feed slot 2*a* by the user to perform the second printing process.

Embodiment 3

Next, Embodiment 3 in which an image is formed on chip-embedded sheet ICS will be described with reference to FIG. 9 and FIG. 10.

Figure 9:
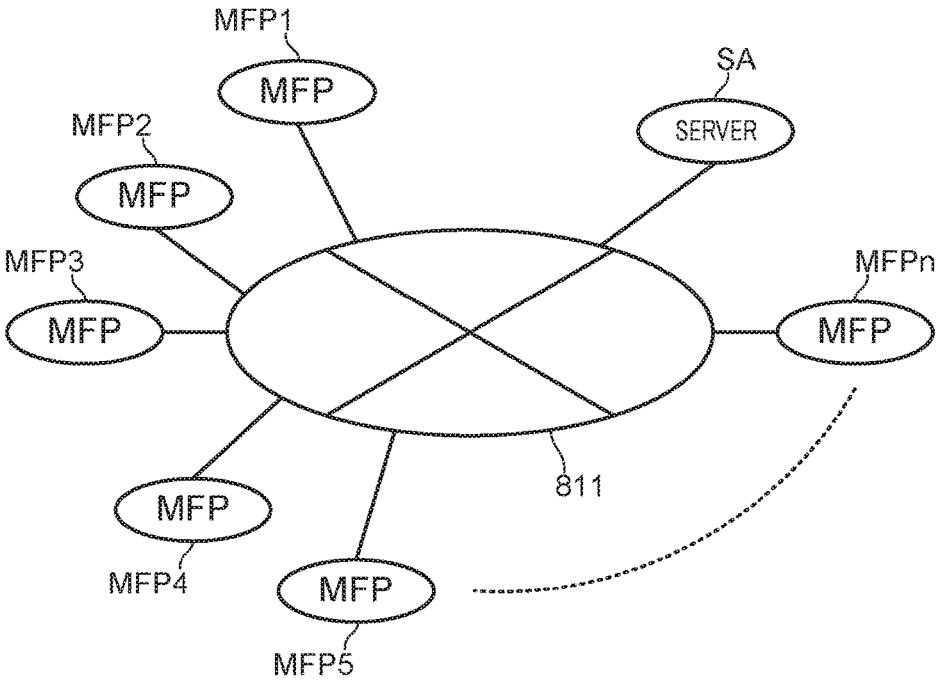
FIG. 9 is diagram showing an overall configuration of a network system according to Embodiment 3.
Figure 10:
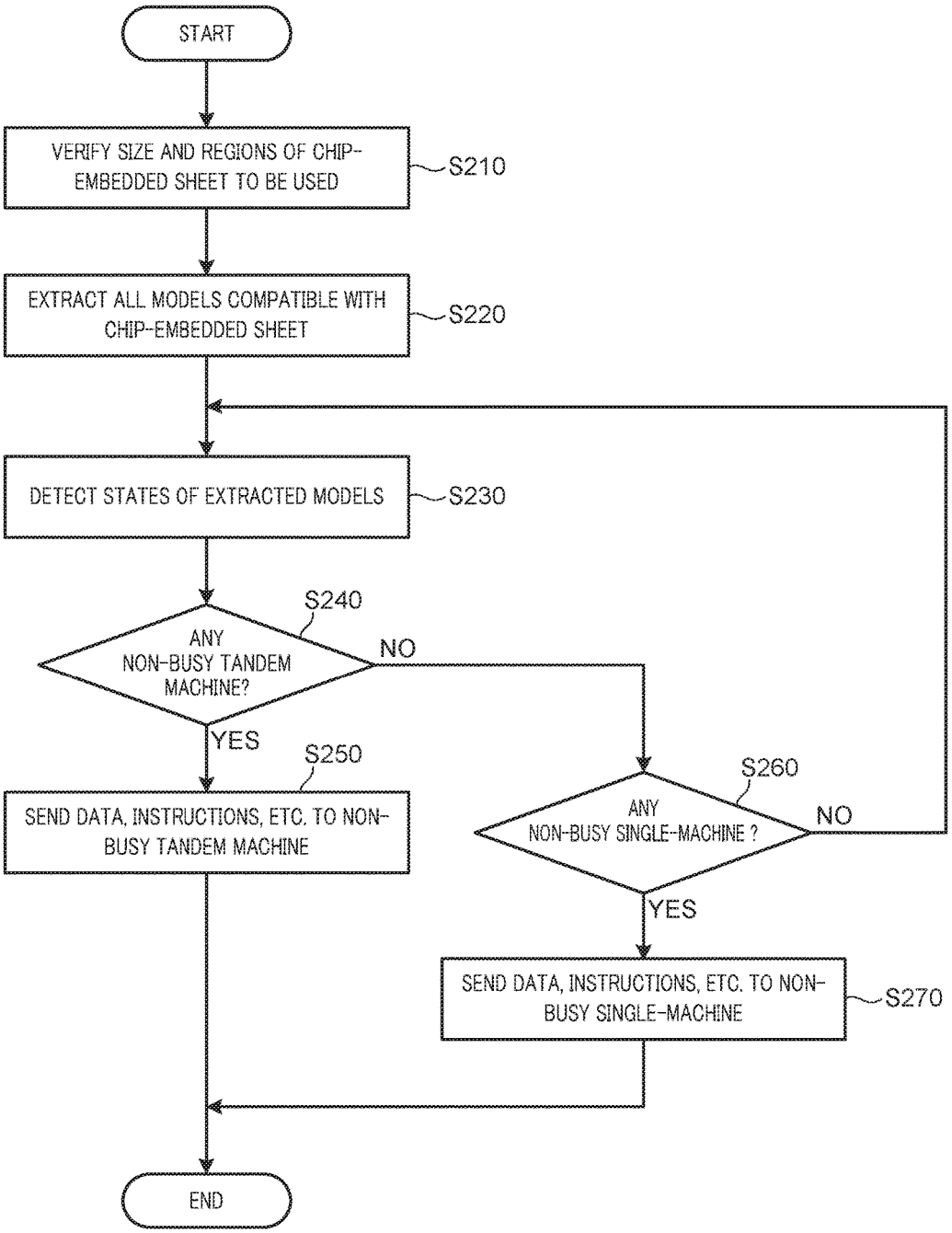
FIG. 10 is a flowchart explaining a processing flow for forming an image on a chip-embedded sheet in the network system of FIG. 9.

FIG. 9 is diagram schematically showing an overall configuration of a network system according to Embodiment 3. The network system shown in FIG. 9 is connected with plural MFPs (Multi Function Peripherals) and server SA via network 811 such as the Internet, a LAN, or a communication network, where server SA centrally controls plural MFPs (MFP1 to MFPn). Then, a print job transmitted from an external apparatus such as a PC is received by server SA, and thus can be executed by any of the MFPs (destination) through server SA.

Here, as a printing apparatus adapted to form images on a sheet, MFP includes the series-tandem image forming system described above (hereinafter referred to as a tandem machine) and the stand-alone image forming apparatus described above (hereinafter referred to as a single-machine). Also, a job management program is stored in a memory (recording medium) in server SA. By reading and executing the job management program, server SA assigns print jobs to pre-registered MFPs (MFP1 to MFPn), making any of the MFPs execute the print jobs.

A process performed by server SA based on the job management program when a print job of forming an image on chip-embedded sheet ICS is received by server SA will be described below with reference to FIG. 10.

In Step S210, by referring to data on the received print job, server SA verifies the size, first region (thin-sheet section $A_1$), and second region (thick-sheet section $A_2$) of chip-embedded sheet ICS to be used and temporarily stores the data on chip-embedded sheet ICS in the memory and the like.

In Step S220, of the MFPs registered on the network, server SA extracts all the MFP models compatible with chip-embedded sheet ICS to be used.

In Step S230, server SA detects the states (operating status) of the extracted models (MFPs) and determines, in Step S240 next, whether there is any tandem machine that is not busy. When it is determined that there is a non-busy tandem machine (YES in Step S240), server SA goes to Step S250 and sends data, instructions, and the like concerning the print job to the non-busy tandem machine. Note that if there are two or more non-busy tandem machines, server SA selects the tandem machine that can process the print job most quickly and transmits the data, instructions, and the like concerning the print job.

Here, the data concerning the print job includes the input image data as well as the data on chip-embedded sheet ICS temporarily stored in Step S210. The data on instructions concerning the print job includes an instruction to form and fix the image in the first region (thin-sheet section $A_1$) in the first printing process (on the first, upstream apparatus) and an instruction to form and fix the image in the second region (thick-sheet section $A_2$) in the second printing process (on the second, downstream apparatus). Also, the data concerning the print job may include an instruction to do fixing using a fixing load 25 to 45% lower than normal in the printing processes.

On the other hand, when it is determined that there is no non-busy tandem machine (NO in Step S240), server SA goes to Step S260 and determines whether there is any single-machine that is not busy. When it is determined that there is a non-busy single-machine (YES in Step S260), server SA goes to Step S270 and sends data, instructions, and the like concerning the print job to the non-busy single-machine. Note that if there are two or more non-busy single-machines, server SA selects the single-machine that can process the print job most quickly and transmits the data, instructions, and the like concerning the print job.

Here, as with the above case, the data concerning the print job includes the input image data as well as the data on chip-embedded sheet ICS temporarily stored in Step S210. Also, the data concerning the print job includes an instruction to form and fix the image in the first region (thin-sheet section) in the first printing process and an instruction to form and fix the image in the second region (thick-sheet section) in the second printing process. Also, the data concerning the print job may include an instruction to do fixing using a fixing load 25 to 45% lower than normal in the printing processes.

On the other hand, when it is determined that there is no non-busy single-machine (NO in Step S260), server SA returns to Step S230 and waits until any tandem machine or single-machine becomes free among the MFPs compatible with chip-embedded sheet ICS to be used.

In this way, in the present network system, upon receiving a print job of printing on chip-embedded sheet ICS, server SA specifies an MFP for use in the print job by taking the operating status of the registered MFPs into consideration, and sends instructions such as described above to the specified MFP. This configuration ensures both good fixability and durability of the members forming the fixing nip on the MFP instructed to execute the print job.

Also, in the present network system, in relation to the print job of printing on chip-embedded sheet ICS, since the job is assigned preferentially to a non-busy tandem machine, productivity is improved in printing toner images on chip-embedded sheet ICS.

In the embodiment described above, chip-embedded sheet ICS made up of two sheets (S1 and S2) with an IC chip sandwiched therebetween has been shown as an example of a sheet nonuniform in sheet thickness, the nonuniform sheet being made up of the first region of small sheet thickness and second region of large sheet thickness. However, the sheet nonuniform in sheet thickness is not limited in this, and other types of sheet can effectively be used in the present invention, where examples of the other types of sheet include a sheet in which any of various objects such as an electronic music box, pressed flower, and circuit pattern is sandwiched between two sheets S1 and S2 and the sandwiching portion (second region) is 1.5 to 3 times as thick as the other portion (first region) smaller in sheet thickness.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming system comprising a first image forming apparatus and a second image forming apparatus, the first and the second image forming apparatuses including respective image formers and fixers, where the image forming system forms an image on a sheet using the first image former, and then forms an image on the sheet using the second image forming apparatus, wherein, in a case where an image is formed on a sheet which is nonuniform in sheet thickness and which includes a first region having a small sheet thickness and a second region having a large sheet thickness, the image in the first region is formed and fixed using the first image forming apparatus and the image in the second region is formed and fixed using the second image forming apparatus, and the respective fixers of the first and the second image forming apparatuses pass the sheet which is nonuniform in sheet thickness, while applying a second load as a fixing load, lower than a first load applied to a sheet which is uniform in sheet thickness.

2. The image forming system according to claim 1, wherein the fixers pass the sheet which is nonuniform in sheet thickness, while applying the second load even in a case where the image is formed on the sheet which is nonuniform in sheet thickness by the image forming section of only one of the first and the second image forming apparatuses.

3. The image forming system according to claim 1, wherein, in the sheet which is nonuniform in sheet thickness, the second region is 1.5 to 3 times as thick as the first region.

4. The image forming system according to claim 1, wherein the sheet which is nonuniform in sheet thickness is a chip-embedded sheet in which an IC chip is placed in the second region.

5. The image forming system according to claim 1, further comprising a conveyance controller that controls conveyance of the sheet, wherein, when the image is formed on the sheet which is nonuniform in sheet thickness, the conveyance controller performs conveyance control such that the sheet which is nonuniform in sheet thickness is conveyed to the second image forming apparatus while a surface of the sheet on which the image is formed by the first image forming apparatus is held.

6. An image forming method for forming, using an image forming apparatus including an image former and a fixer, an image on a sheet which is nonuniform in sheet thickness and which includes a first region having a small sheet thickness and a second region having a large sheet thickness, the image forming method comprising forming and fixing an image in the first region in a first printing process and forming and fixing an image in the second region in a second printing process, wherein in the first and the second printing processes, the fixer passes the sheet which is nonuniform in sheet thickness, while applying a second load as a fixing load, lower than a first load applied to a sheet which is uniform in sheet thickness.

7. The image forming method according to claim 6, wherein the fixers pass the sheet which is nonuniform in sheet thickness, while applying the second load even in a case where the image is formed on the sheet which is nonuniform in sheet thickness, by only one of the first and the second printing processes.

8. An image forming apparatus comprising:

an image former that forms a toner image on a sheet;

a fixer that fixes the toner image on the sheet; and a hardware processor that controls, in a case where the image is formed on a sheet which is nonuniform in sheet thickness and which has a first region having a small sheet thickness and a second region having a large sheet thickness, the image former and the fixer such that a toner image in the first region is formed and fixed in a first printing process and an image in the second region is formed and fixed in a second printing process, wherein the hardware processor controls the fixer so as to pass the sheet which is nonuniform in sheet thickness and to apply at the same time a second load as a fixing load in the first and the second printing processes, lower than a first load applied to a sheet which is uniform in sheet thickness.

9. The image forming apparatus according to claim 8, further comprising a circulation conveyance path running from a downstream side of the fixer in a conveyance direction to an upstream side of the image former in the conveyance direction, wherein the hardware processor performs conveyance control such that after the first printing process, the sheet which is nonuniform in sheet thickness is conveyed to the image former through the circulation conveyance path.

10. A job management method for assigning a print job to printing apparatuses each being configured to form an image on a sheet and registered on a network, each of the printing apparatuses being either a tandem machine including first and second image forming apparatuses including respective image formers and fixers, or a single-machine including an image former and a fixer, wherein, when a print job of forming an image on a sheet which is nonuniform in sheet thickness and which has a first region having a small sheet thickness and a second region having a large sheet thickness is received, at least one of the printing apparatuses that executes the print job is specified by taking operating statuses of the registered printing apparatuses into consideration, and the specified printing apparatus is instructed to:

form and fix an image in the first region in a first printing process and form and fix an image in the second region in a second printing process; and apply a second load as a fixing load in the first and the second printing processes, lower than a first load applied to a sheet which is uniform in sheet thickness.

11. The job management method according to claim 10, wherein, when both the tandem machine and the single-machine are registered on the network, a print job of forming an image on the sheet which is nonuniform in sheet thickness is assigned preferentially to the tandem machine.

12. The job management method according to claim 10, comprising:

determining whether each of the registered printing apparatuses is busy; and assigning a print job of forming an image on the sheet which is nonuniform in sheet thickness to at least one of the printing apparatuses that is not busy.

13. A computer-readable non-transitory recording medium storing a job management program executed by a server that assigns a print job to printing apparatuses each being configured to form an image on a sheet and registered on a network, each of the printing apparatuses being either a tandem machine including first and second image forming apparatuses including respective image formers and fixers, or a single-machine including an image former and a fixer, wherein the job management program causes the server to carry out a procedure comprising:

specifying at least one of the printing apparatuses that executes the print job, by taking operating status of the registered printing apparatuses into consideration, upon receiving a print job of forming an image on a same side of a sheet which is nonuniform in sheet thickness and which has a first region having a small sheet thickness and a second region having a large sheet thickness; and instructing the specified printing apparatus to form and fix an image in the first region in a first image formation process and form and fix an image in the second region in a second image formation process and apply a second load in the first and the second printing processes, lower than a first load applied to a sheet which is uniform in sheet thickness.

14. The computer-readable non-transitory recording medium storing a job management program according to claim 13, wherein the job management program causes the server to carry out a procedure of assigning a print job of forming an image on the sheet which is nonuniform in sheet thickness preferentially to the tandem machine when both the tandem machine and the single-machine are registered on the network.

15. The computer-readable non-transitory recording medium storing a job management program according to claim 13, wherein the job management program causes the server to carry out a procedure comprising:

determining whether each of the registered printing apparatuses is busy; and assigning the print job of forming an image on the sheet which is nonuniform in sheet thickness to at least one of the printing apparatuses that is not busy.

* * * * *